United States Patent [19]

Kahn

[11] Patent Number: 4,660,225

[45] Date of Patent: Apr. 28, 1987

[54] ORNAMENTAL BIB

[76] Inventor: Beatrice Kahn, P.O. Box A, Tarzana, Calif. 91356

[21] Appl. No.: 768,731

[22] Filed: Aug. 23, 1985

[51] Int. Cl.[4] ..... A41B 13/10

[52] U.S. Cl. ..... 2/49 R

[58] Field of Search ..... 2/49, 48; 350/98, 638

[56] References Cited

U.S. PATENT DOCUMENTS

| | | | |
|---|---|---|---|
| 291,033 | 1/1884 | Couch | 350/638 |
| 1,739,289 | 12/1929 | Carter | 350/98 |
| 2,747,192 | 5/1956 | Katz . | |
| 2,835,895 | 5/1958 | Wells | 2/49 R |
| 3,547,765 | 12/1970 | Snyder et al. . | |
| 3,833,937 | 9/1974 | Taylor . | |
| 3,837,007 | 9/1974 | Girest | 2/126 |
| 3,914,797 | 10/1975 | Stembridge . | |
| 3,916,447 | 11/1975 | Thompson . | |
| 4,365,354 | 12/1982 | Sullivan | 2/DIG. 11 |

FOREIGN PATENT DOCUMENTS

| | | | |
|---|---|---|---|
| 633838 | 8/1936 | Fed. Rep. of Germany | 350/98 |

*Primary Examiner*—Doris L. Troutman

*Attorney, Agent, or Firm*—Albert F. Kronman

[57] ABSTRACT

A bib for protecting a wearer's clothing during eating having fastening means to secure it about the neck is made of a flexible fabric having a highly light reflective coating or layer on the outer surface thereof. Ambient light received upon the reflective coating is directed upwardly upon the face and hair of the wearer to enhance the wearer's appearance.

6 Claims, 4 Drawing Figures

ORNAMENTAL BIB

BACKGROUND OF THE INVENTION

Protective garments collectively known as bibs have been in wide use for many years. Such garments are worn across the front of clothing during dining for the purpose of preventing staining and are usually made of liquid absorbent material such as cotton, paper or woven or unwoven cloth fibers. When secured about a person's neck and draped over the wearer, they present an unflattering appearance and therefore are often supplied as a throw-away article to be discarded as soon as convenient.

Accordingly, it is an object of the present invention to provide a bib which will serve the purpose of prior art bibs while presenting an attractive and flattering appearance for the wearer.

Another object of the present invention is to provide a bib which can be conveniently carried about and reused from time to time.

A further object of the present invention is to provide a bib which is easy to put on and remove.

SUMMARY OF THE INVENTION

In a preferred form of the invention, a bib of conventional shape and size is made of a suitable fabric such as nylon having a highly reflective layer of metallic gold, silver or the like laminated, sprayed or otherwise deposited upon the outer or exposed surface thereof. Suitable fastening means such as snaps, buttons or Velcro fasteners are provided to secure the bib about the neck of the wearer so that the bib is draped over the wearer's clothing to protect it. The material of which the bib is made is suitably flexible so that it may be readily folded and stored for reuse.

DESCRIPTION OF THE DRAWINGS

In the accompanying drawing forming part hereof, similar elements have been given the same reference numerals, in which drawings.

DETAILED DESCRIPTION

Figure 1:
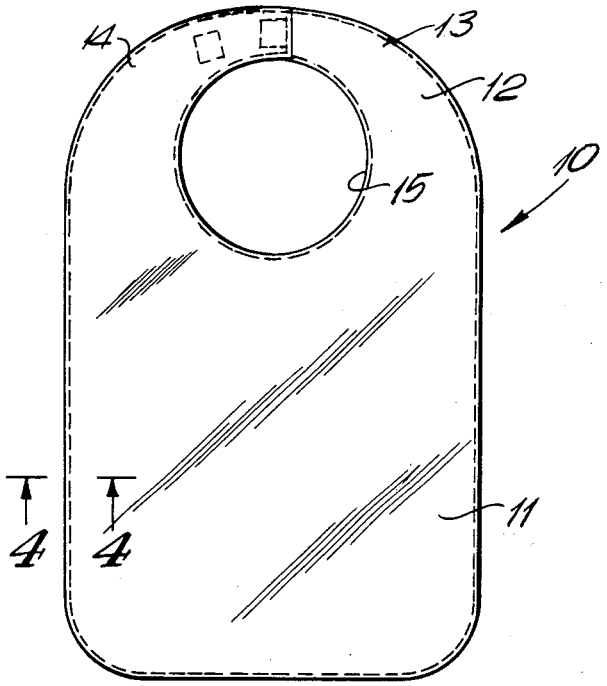
FIG. 1 is a view in front elevation of a bib made in accordance with the present invention.
Figure 2:
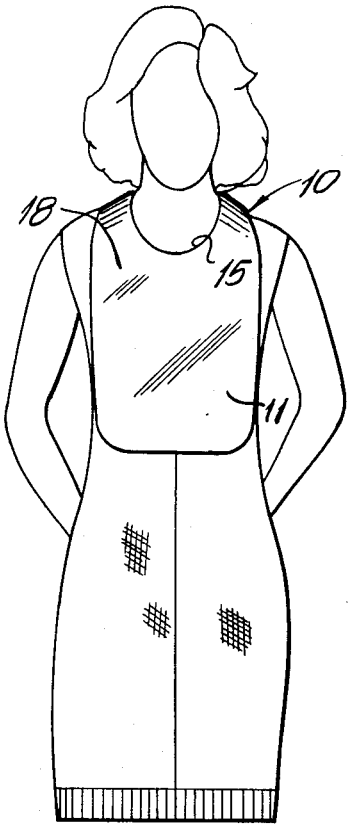
FIG. 2 is an elevational fragmentary view showing the manner in which the bib may be worn.

Referring to the drawing and particularly FIGS. 1 and 2, there is shown a bib 10 having a protective body portion 11 and a yoke 12 for securing the bib about the neck of the wearer. The yoke is preferably made of two strips of material 13,14 which may be integral with the bib body portion 11 or sewed thereto. Alternately, the neck receiving opening 15 of the yoke may be made large enough to slip over the wearer's head without departing from the spirit of the invention.

Figure 3:
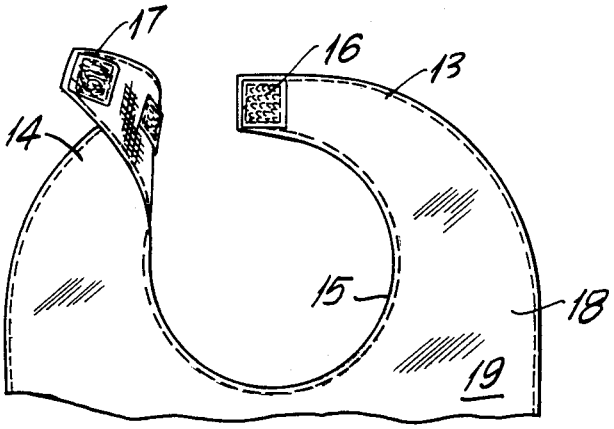
FIG. 3 is an elevational fragmentary view of the bib fastening structure shown in FIG. 1.
Figure 4:
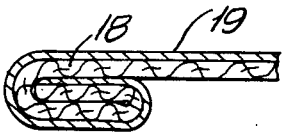
FIG. 4 is a cross-sectional view taken on line 4—4 in FIG. 1.

Preferably, the yoke 12 is made as shown in FIGS. 1 and 3 so that the bib will fit snugly about the neck and provide maximum protection. The strips 13,14 are provided with fastening means 16,17 as best shown in FIG. 3. A preferred fastening means consists interlocking piled members known as Velcro fasteners, which may be coupled and uncoupled repeatedly, are unobtrusive and will withstand repeated laundering.

The material of which the bib is made is of a suitable fabric 18 such as one containing 82% nylon, 1% MIT and 17.7% Havesene. such material must be flexible, strong enough to be folded and refolded repeatedly and capable of laundering. A highly, light reflective coating or layer 19 overlies the material 18. the reflecting coating 19 may be a layer of nylon tricot lame such as is commercially sold under the trademark Fabrite by Fabrite Laminating Corporation or a thin, flexible, light reflecting coating. Various colors may be used in the coating 19 such as red, yellow, blue, etc., providing they do not destroy the light reflecting ability of the said coating, an important feature of the present invention.

When a bib made in accordance with the present invention is placed upon a person in the manner shown in FIG. 2, ambient light striking the reflective surface coating 19 will be directed upwardly upon the wearer's face and hair, producing a flattering and attractive glowing appearance. The bib becomes an accessory to the wearer's clothes, and may be left in place to enhance rather than detract from the wearer's appearance.

Having thus fully described the invention what is desired to be claimed and secured by Letters Patent is:

1. A protective bib comprising a garment protective body portion of flexible material, a yoke on said bib for attachment about the neck of the wearer, and a layer of a highly light reflecting Nylon fabric material carried upon the outer surface of the body portion and adapted to reflect light toward the face and head of the wearer.

2. A protective bib according to claim 1 in which the nylon fabric contains 82% nylon, 1% MIT and 17% Havesene.

3. A protective bib according to claim 1 in which the light reflecting material is in the form of a coating applied directly to the body portion.

4. A protective bib according to claim 1 in which the light reflecting material is a layer laminated to the body portion.

5. A protective bib according to claim 4 in which the light reflecting layer is a nylon tricot lame.

6. A protective bib according to claim 5 in which the nylon tricot lame is colored.

* * * * *